US010450754B2

(12) United States Patent
Goodwin et al.

(10) Patent No.: US 10,450,754 B2
(45) Date of Patent: Oct. 22, 2019

(54) ROOF EDGE SEAL AND BARRIER DEVICES AND THEIR MANUFACTURE

(71) Applicant: NASTYSTOP HOLDINGS PTY LTD, Torquay, Vic (AU)

(72) Inventors: David Malcolm Goodwin, Pyrford (GB); Mark Graham Johnston, Fleet (GB)

(73) Assignee: NASTYSTOP HOLDINGS PTY LTD, Torquay (AU)

( * ) Notice: Subject to any disclaimer, the term of this patent is extended or adjusted under 35 U.S.C. 154(b) by 306 days.

(21) Appl. No.: 15/356,230

(22) Filed: Nov. 18, 2016

(65) Prior Publication Data

US 2017/0145696 A1 May 25, 2017

(30) Foreign Application Priority Data

Nov. 20, 2015 (AU) ..... 2015904792

(51) Int. Cl.

| | |
|---|---|
| ***E04D 5/12*** | (2006.01) |
| ***E04D 5/08*** | (2006.01) |
| ***B21D 28/00*** | (2006.01) |
| ***E04B 1/70*** | (2006.01) |
| ***E04B 1/66*** | (2006.01) |
| ***E04B 1/72*** | (2006.01) |
| ***E04D 5/14*** | (2006.01) |
| ***E04D 13/17*** | (2006.01) |
| ***B21D 28/02*** | (2006.01) |
| *B21D 28/10* | (2006.01) |

(52) U.S. Cl.

CPC ..... *E04D 5/12* (2013.01); *B21D 28/00* (2013.01); *B21D 28/02* (2013.01); *E04B 1/66* (2013.01); *E04B 1/70* (2013.01); *E04B 1/72* (2013.01); *E04D 5/08* (2013.01); *E04D 5/144* (2013.01); *E04D 13/172* (2013.01); *B21D 28/10* (2013.01)

(58) Field of Classification Search

CPC ..... E04D 5/12; E04D 13/172; E04D 5/08; E04D 5/144; B21D 28/02; B21D 28/00; B21D 28/10; E04B 1/66; E04B 1/72; E04B 1/70

See application file for complete search history.

(56) References Cited

U.S. PATENT DOCUMENTS

| | | | |
|---|---|---|---|
| 6,243,995 B1 | 6/2001 | Reeves et al. | |
| 2003/0005649 A1 | 1/2003 | Austin et al. | |

FOREIGN PATENT DOCUMENTS

| | | | | |
|---|---|---|---|---|
| AU | 197839621 A1 | | 3/1980 | |
| AU | 2008101266 A4 | | 4/2009 | |
| EP | 0084909 A2 | | 8/1983 | |
| FR | 2539787 A1 | | 7/1984 | |
| GB | 345611 | * | 3/1931 | ..... A46B 3/08 |
| NL | 1002170 C2 | | 9/1996 | |

* cited by examiner

*Primary Examiner* — John C Hong
(74) *Attorney, Agent, or Firm* — Tredecim LLC; Sean L. Sweeney; Taylor A. Noonan

(57) ABSTRACT

The present invention is directed roof edge seal and barrier devices and their method of manufacture. A method of manufacturing a comb-like sealing strip for use as a roof edge seal or barrier comprises stamping or cutting an elongate strip of material along a sinuous path located between the edges of the strip and then separating the strip into two portions, each of which consists of a fixing edge corresponding to the edge of the original strip from which project a series of teeth or prongs forming a comb structure.

12 Claims, 5 Drawing Sheets

ROOF EDGE SEAL AND BARRIER DEVICES AND THEIR MANUFACTURE

BACKGROUND

1. Field of the Invention

This invention relates to roof edge seal and barrier devices and their manufacture.

2. Discussion of Background Information

There are a very wide variety of roof constructions, which generally consist of a supporting structure on to which roofing materials are laid in a fashion which provides a waterproof seal so that when rain falls on the roof, it runs off rather than penetrating into the building concerned. Inside the roof, it is desirable that the roof space is not sealed but rather ventilated.

Problems arise in connection with providing a structure at the edge of the roof where it overlies the walls of the building below it, and which resists water penetration but which still allows the roof space to "breathe". This may be achieved in a variety of traditional ways, and is generally relatively easily achieved when the underside of the roofing material is relatively flat. In the case of roofing materials which do not have a flat underside, for example corrugated sheeting or non-flat tiles, it is generally necessary to provide some sort of structure or material to fill in the gaps. This is laborious to achieve by individually filling each gap e.g. with a settable mortar or like material, and a wide variety of sealing strips have been developed. The purpose of such strips is not merely to generally seal the gaps, but to ensure that they are sealed adequately not only against the ingress of water, but against wildlife, for example small birds who may wish to nest in the roof, bats, rodents and a wide variety of flying insects. It would be desirable for the seal to work to prevent the ingress of non-flying creatures, such as slugs, snails and spiders, though, in the case of the last of these, small spiders will inevitably be able to get into a roof space via very small passages at the edges where the roof sits on the wall.

Particularly for use with corrugated tiles or corrugated sheet roofs, a number of proposals have been made. U.S. Pat. No. 6,243,995 and 2003/0005649 disclose systems for fitting under curved roof tiles at the edge of a roof while Specifications EP 0084909, NL 1002170, FR 2539787 and published Australian Applications 39621/78 and 2008101266 disclose a variety of strips including a comb-like formation where the individual teeth may be flexed or bent to provide a set of adjacent bars which constitute a barrier to entry of undesired wildlife between corrugated sheeting or tiles and a flat base constituted by the top of a wall. An advantage of such a system is that strips may be fixed in place with the teeth protruding at an appropriate angle and then, as the roofing components are laid, the underside of each component bends the teeth so that they conform to the shape of the underside of the roofing material and constitute an appropriate barrier.

Such comb-like seal strips are conventionally produced of metal by stamping the teeth out from a metal strip. This is a process which gives rise to substantial quantities of stampings which, while they might be recyclable, are often simply disposed of as waste.

For clarity, any prior art referred to herein, does not constitute an admission that the prior art forms part of the common general knowledge, in Australia or elsewhere.

SUMMARY OF THE INVENTION

It is an object of the present invention to provide a roof edge seal and barrier device and their manufacture, that at least ameliorates one or more of the aforementioned problems of the prior art.

According to a first feature of the present invention, there is provided a method of manufacturing a comb-like sealing strip for use as a roof edge seal or barrier which comprises stamping or cutting an elongate strip of material along a sinuous path located between the edges of the strip and then separating the strip into two portions, each of which consists of a fixing edge corresponding to the edge of the original strip from which project a series of teeth or prongs forming a comb structure.

The separation of the two parts of the strip into two comb-like members may be effected by way of a continuous process, but may also take place in two stages:

In the first stage, the strip is punched or cut along a sinuous line, but with interruptions which constitute bridges of unpunched or cut material which maintain the two edges of the strip together. The size of the interruptions should be sufficient to hold the two edges of the strip together but such that the two comb "half strips" can then be separated easily when desired. This approach has the particular advantage that, in the first stage, the strip may be uncoiled and then re-coiled which makes transportation considerably easier. In the second stage, for example where the strip is to be used in the construction of a roof structure, the two halves of the strip may be simply separated either by manually pulling them apart, or using a simple pair of inter-engaging rollers with a relief pattern on them corresponding to the sinuous cut and where the rollers inter-engage in such a way that, as the strip is passed through the pair of rollers, the adjacent tooth of the teeth or prongs of the comb-like structure are separated from one another.

Such a roller pair may be associated with a folding or creasing mechanism which acts to provide a fold or crease between the edge of the emerging comb-like strip and a location near or at the line where the individual teeth or prongs join the strip. It is even conceivable to impress dents, or, indeed, to punch holes in the continuous edge of each strip as it passes through such an apparatus in order to act as a guide for nails used to affix the strip in place e.g. on to a wall plate using an appropriate pin or nail, which punches through the strip or which is nailed through the punched hole.

Such folding or bending of the edge of the strip may be facilitated if desired by forming, in the first stage of the manufacturing process, a number of cuts or slots extending parallel to the side edges of the strip as it is originally punched in the first stage of manufacture.

In a separate approach, a strip of material may be punched with a plurality of transverse slots and the centre of the strip then parted to provide two strips, one or both having a comb-like set of teeth on it.

In a further development, subsequent to the separation of the strip into two comb-like structures, the comb-like portion may be provided with an overlay of flexible material which may have a fine texture and which ensures that the gaps between the individual teeth, once the comb-like strip has been installed and the roof structure has been placed on them, resist penetration better from, for example, small flying insects. A highly elastic fabric or netting may be applied to one side of the comb, or, for example, a loosely flocked or felted material, for example a loose non-woven fabric made of an appropriately resistant material, such as steel wool or synthetic plastics material such as nylon, may be applied to one side of the comb or, if of suitable thickness, impaled on the teeth of the comb.

In an alternative approach, the strip may be made by punching a plurality of transverse slots in a strip of material which is then converted into a comb-like structure by shaving off the edge of the strip to produce the comb-like structure. As noted above, this may be done on site, i.e. adjacent the building where the strip is to be installed during construction of the roof. An advantage of the approach is that the width of the teeth may be greater than the gaps between them.

The strip of material from which the comb-like sealing strips are made can be of any suitable, deformable, punchable material. A preferred material is coated steel sheet, and a preferred sheet thickness is around 0.55 mm.

BRIEF DESCRIPTION OF THE DRAWINGS

The invention is illustrated by way of example with reference to the accompanying drawings in which.

DETAILED DESCRIPTION OF THE INVENTION

Figure 1:
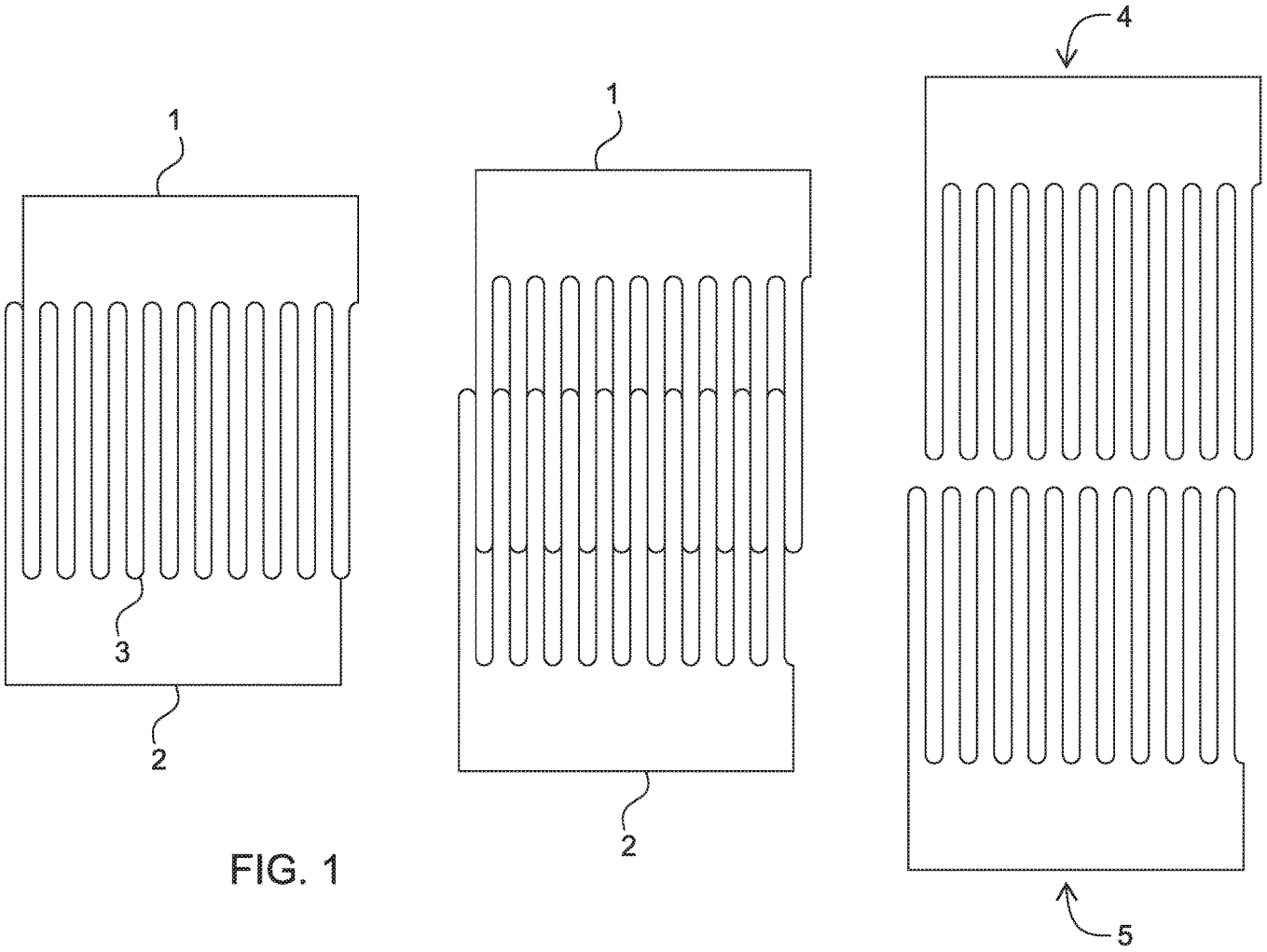
FIG. 1 is a diagrammatic representation of the method of manufacture.

Referring first to FIG. 1, this shows diagrammatically a section of a strip of material having two edges 1, 2 and which has been cut, for example, by punching along a sinuous line 3 using a suitable machine. The output of the machine can be chopped into appropriate lengths and the two sides of the strip 1 and 2 are then pulled apart to leave two separate comb-like units 4 and 5 shown at the right of the drawing.

Figure 2:
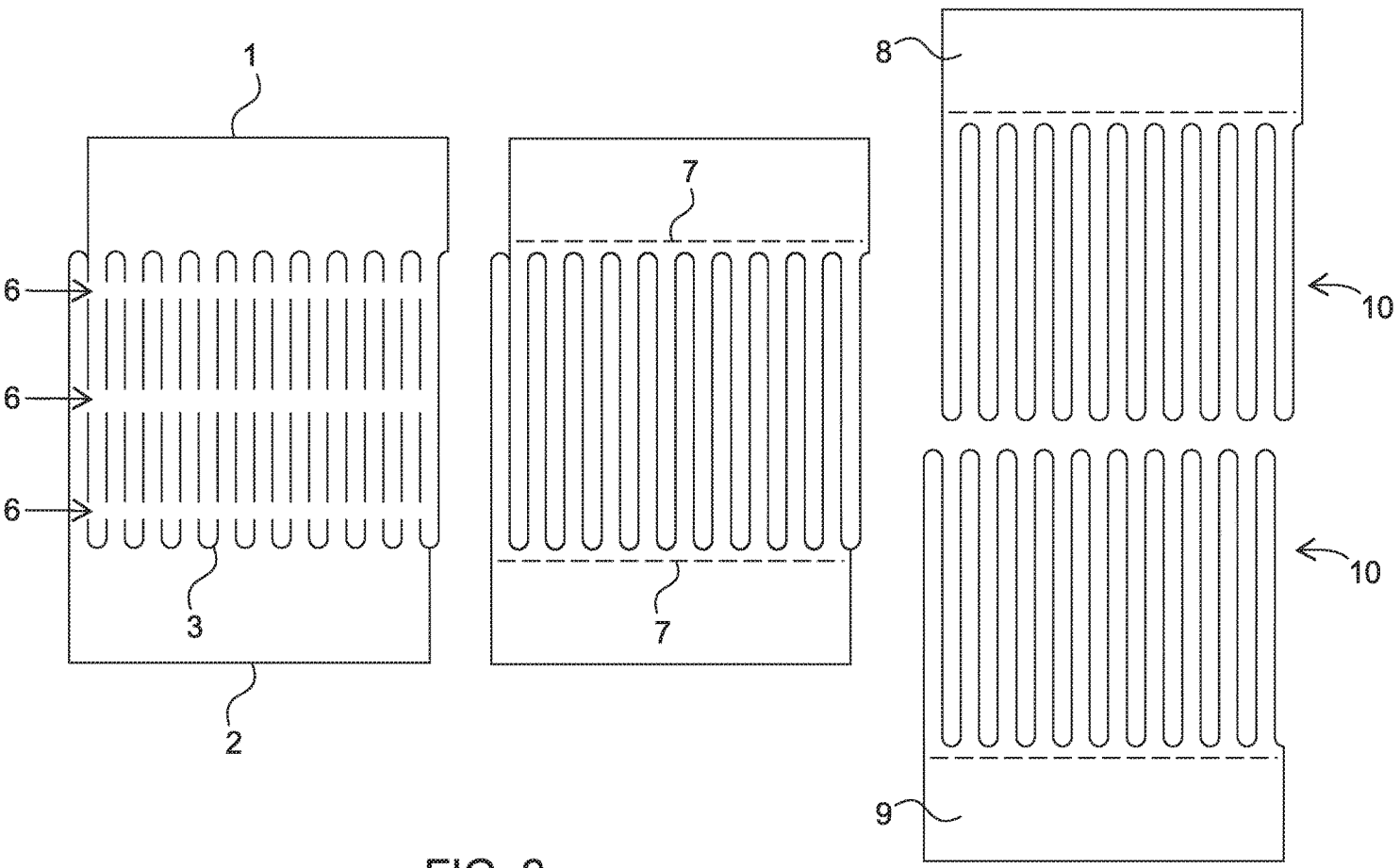
FIG. 2 is a diagrammatic representation of an alternative method of manufacture.

FIG. 2 shows an alternative approach where the sinuous punch line 3 is interrupted at three separate positions 6. These are shown at the left-hand side of FIG. 2 only. In addition, a series of slits or slots 7 are provided running along the strip. Slits 7 constitute an area of weakening enabling the side portions denoted 8 and 9 on the right-hand side of FIG. 2 to be bent relative to the plane of the teeth of the comb which is produced by separating the two sections with fracture of the small connecting areas along the lines 6. As can be seen on the right-hand side of FIG. 2, extending from each of the side members 8 and 9 is a set of prongs or teeth 10.

Figure 3:
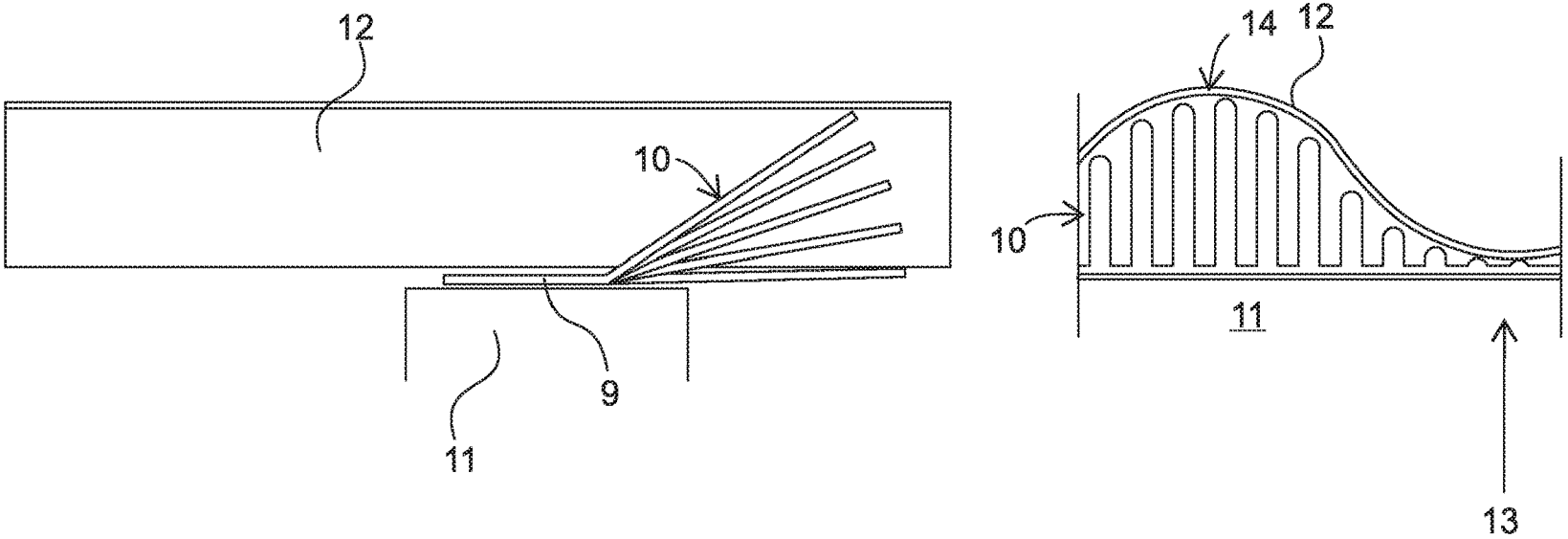
FIG. 3 shows how the manufactured product is installed.

FIG. 3 shows the installation of the units shown in FIG. 2 on the right-hand side below a corrugated roofing sheet 12. The side portion 9 is first bent relative to the prongs or teeth 10 and then fixed to the top of a wall 11. When the corrugated sheet 12 is placed on top, it depresses the prongs or teeth 10, to a maximum extent at the lowest portions of sheet 12, shown at 13 in the right-hand side of FIG. 3, and to a minimum extent at the top, denoted 14 on the right-hand side of FIG. 3.

Figure 4:
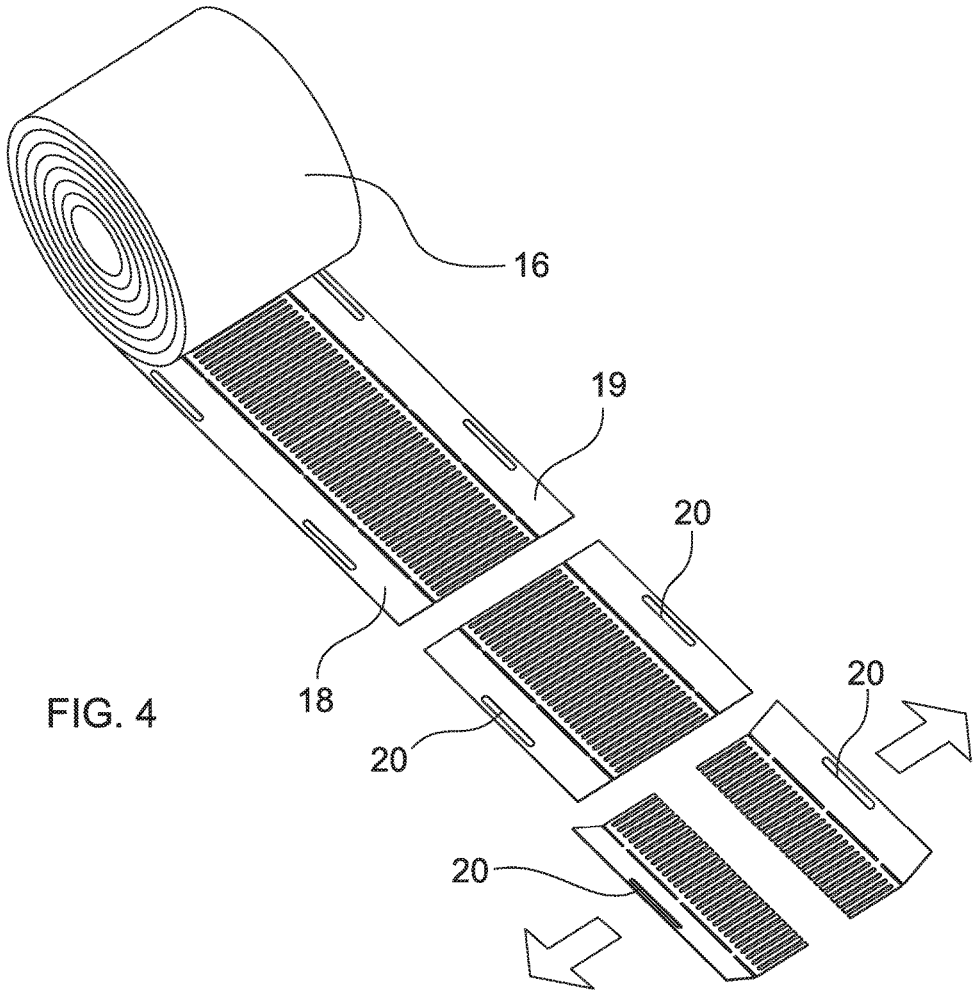
FIG. 4 is a diagrammatic illustration of a further alternative.

FIG. 4 shows diagrammatically a roll of material such as can be delivered to a site where the edge seal/barrier is to be installed. As can be seen, the strip rolled into a roll 16 has two edge portions 18 and 19, each of which has a series of punched slots in it at regular intervals denoted 20 which serve to enable a nail or like fixing to be inserted through the edge of the strip to hold it down against the top of a wall.

The edge portions 18 and 19 may be bent up using an appropriate jig or die or an appropriate machine to a position as shown in the right-hand side of FIG. 4 and, at the same time, the strip can be bisected centrally to form two comb-like portions, each of which can then be used to form an edge seal/barrier in a roofing structure of the type described.

Figure 5:
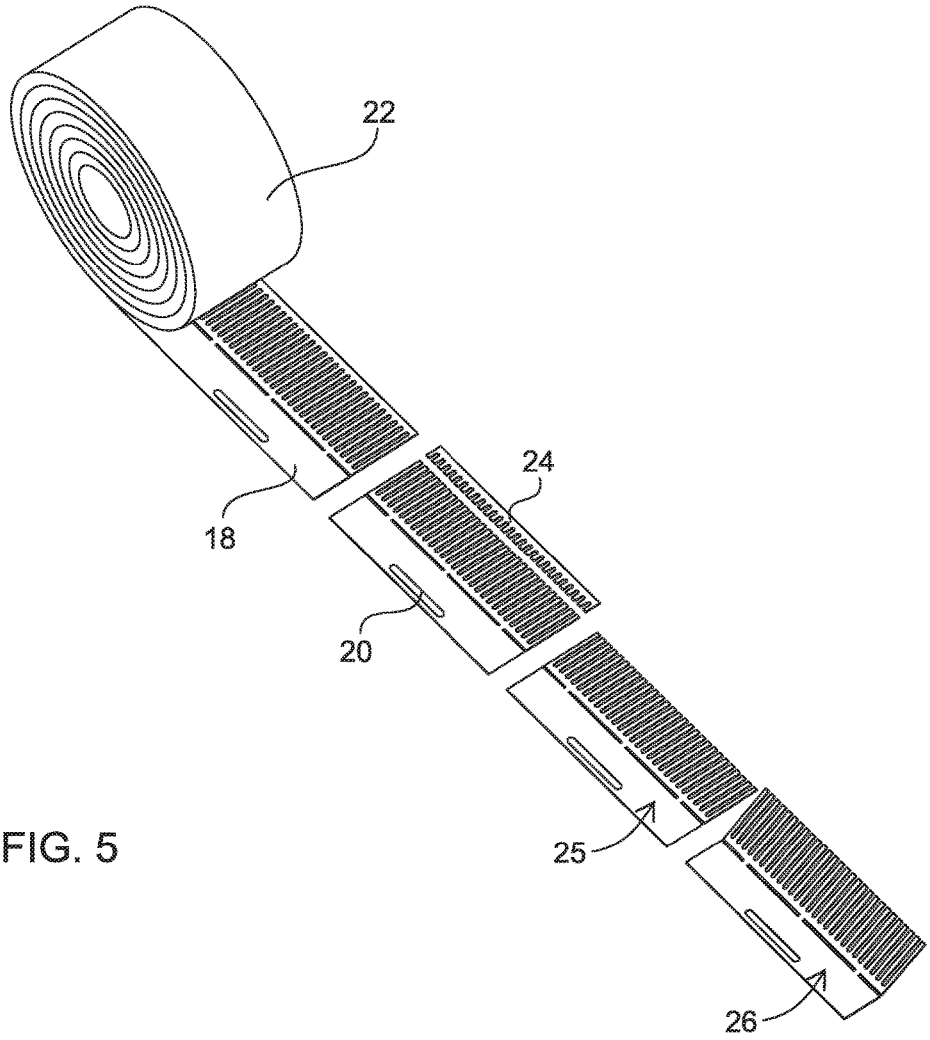
FIG. 5 is a diagrammatic illustration of a separate further alternative approach.

In the alternative structure shown in FIG. 5, the roll 22 has a side region 18 with punched holes 20 in it as in the case of FIG. 4, but the opposite side of the strip is formed with a very narrow continuous portion 24 which may be cut or snapped off to leave the generally flat unit shown at 25 which, following bending, adopts the shape shown at 26. The unit denoted 26 can then be installed as described above.

The rolls 16 and 22 may be made by taking a strip and passing it through a punching machine to provide the apertures, or a sinusoidal cut as described with reference to FIGS. 1 and 2 and the strip then rolled up again for ease of transport. At the site, the strip can be unrolled, treated to provide a series of combs including cutting to the appropriate length by means of a simple shear, and bent using an appropriate jig or by passing the edges through a pair of opposed rollers to provide the desired angle profile.

It will be apparent to a person skilled in the art that changes may be made to the embodiment disclosed herein without departing from the spirit and scope of the invention in its various aspects.

Throughout the specification and claims the use of the term "comprise" and its derivatives is intended to have an inclusive rather than exclusive meaning unless the context determines otherwise.

What is claimed is:

1. A method of manufacturing a comb-like sealing strip for use as a roof edge seal or barrier which comprises stamping or cutting an original elongated strip of material along a sinuous path located between the edges of the original elongated strip and then separating the original elongated strip along the sinuous path into two portions by pulling the two portions apart, wherein each of the two portions consists of a fixing edge corresponding to the edge of the original strip, a side portion extending a distance from the fixing edge, and a series of teeth or prongs extending from the side portion and forming a comb structure wherein each individual tooth or prong in the series of teeth or prongs is spaced apart such that a gap is present between each individual tooth or prong.

2. The method according to claim 1 wherein the original elongated strip is stamped or cut along a sinuous path that includes interruptions of unstamped or uncut material and separating the original elongated strip into the two portions by fracturing the interruptions as the two portions are pulled apart.

3. The method according to claim 2 wherein the original elongated strip is uncoiled prior to being stamped or cut and then re-coiled once the original elongated strip is stamped or cut.

4. The method according to claim 1 wherein, during the separation of the original elongated strip along the sinuous path into two portions, the original elongated strip is passed through a folding or creasing mechanism which acts to provide a fold or crease in the side portion of one or both of the two portions at a location near or at where the series of teeth or prongs extends from the side portion.

5. The method according to claim 4 further comprising the step of impressing dents or punching holes in the side portion of one or both of the two portions to act as a guide for nails.

6. The method according to claim 1 further comprising stamping or cutting a number of cuts or slots extending parallel to the edges of the original elongated strip, in order to facilitate folding or creasing one or both of the two portions.

7. The method according to claim 1 wherein the comb structure is provided with an overlay of flexible material across the gaps between each tooth or prong of the series of teeth or prongs to enable the comb structure to better resist penetration from small flying insects.

8. The method according to claim 1 wherein, following the separation of the original elongated strip along the sinuous path into two portions, one or both of the two portions is passed through a folding or creasing mechanism which acts to provide a fold or crease in the side portion of one or both of the two portions at a location near or at where the series of teeth or prongs extends from the side portion.

9. A method of manufacturing a comb-like sealing strip for use as a roof edge seal or barrier which comprises punching a strip of material with a plurality of transverse slots and subsequently parting the strip to provide two strips, one or both having a comb-like set of teeth on it such that there is a gap between the individual teeth of the comb-like set of teeth and wherein the comb-like set of teeth is provided with an overlay of flexible material across the gaps between the individual teeth to enable the comb-like set of teeth to better resist penetration from small flying insects.

10. A method of manufacturing a comb-like sealing strip for use as a roof edge seal or barrier which comprises punching a plurality of transverse slots in a strip of material and subsequently removing one edge of the strip to produce a comb-like structure having a series of teeth spaced apart such that a gap is present between each tooth and wherein the transverse slots in the strip of material are sized and spaced such that in the comb-like structure, the series of teeth are disposed along a length of the comb-like structure such that the teeth occupy a larger portion of the length of the comb-like structure than the gaps between the teeth.

11. The method according to claim 10 wherein the comb-like structure is provided with an overlay of flexible material across the gaps present between each tooth in the series of teeth to enable the comb-like structure to better resist penetration from small flying insects.

12. The method according to claim 11 which includes applying a highly elastic fabric, netting or loosely flocked or felted material to one side of the comb-like structure or impaling such a material on the series of teeth of the comb-like structure.

* * * * *